United States Patent [19]

Ueda

[11] Patent Number: 4,587,393

[45] Date of Patent: May 6, 1986

[54] HEATING APPARATUS HAVING A SENSOR FOR TERMINATING OPERATION

[75] Inventor: Shigeki Ueda, Kouriyama, Japan

[73] Assignee: Matsushita Electric Industrial Co., Ltd., Osaka, Japan

[21] Appl. No.: 687,271

[22] Filed: Dec. 28, 1984

[30] Foreign Application Priority Data

| | | | |
|---|---|---|---|
| Jan. 5, 1984 | [JP] | Japan | 59-416 |
| Mar. 12, 1984 | [JP] | Japan | 59-47418 |
| Jun. 8, 1984 | [JP] | Japan | 59-118444 |

[51] Int. Cl.[4] ..... H05B 6/68

[52] U.S. Cl. ..... 219/10.55 B; 219/10.55 M; 219/10.55 R; 99/325; 99/DIG. 14; 99/451; 426/243; 426/523

[58] Field of Search ..... 219/10.55 B, 10.55 R, 219/10.55 E, 10.55 F, 482, 490, 10.55 M; 99/325, DIG. 14, 451; 426/241, 243, 234, 523

[56] References Cited

U.S. PATENT DOCUMENTS

| | | | |
|---|---|---|---|
| 3,839,616 | 10/1974 | Risman | 219/10.55 R |
| 4,162,381 | 7/1979 | Buck | 219/10.55 B |
| 4,311,895 | 1/1982 | Tanabe | 219/10.55 B |
| 4,335,293 | 6/1982 | Kobayashi et al. | 219/10.55 B |

FOREIGN PATENT DOCUMENTS

| | | | |
|---|---|---|---|
| 52-13150 | 2/1977 | Japan | 219/10.55 R |

*Primary Examiner*—Philip H. Leung

*Attorney, Agent, or Firm*—Lowe, King, Price & Becker

[57] ABSTRACT

Foodstuff is heated in a chamber ventilated by a fan through an exhaust duct. The duct has a sufficiently long airflow passage to produce a substantially laminar flow therein. An opening at an intermediate position along the duct length faces in a direction substantially perpendicular to the direction of the laminar airflow. The opening is closed by an enclosure so vaporized substance emitted by the foodstuff diffuses from the duct through the opening into the enclosure. A sensor in the enclosure detects the diffusing substance and develops a signal indicating a condition of the foodstuff.

19 Claims, 8 Drawing Figures

FROM SENSOR 30
41
DETECTOR CIRCUIT
MICROCOMPUTER
50
D7
D0
A/D
S4
S3
S2
S1
S0
R3
R1
R0
I3
I2
I1
I0
46
DISPLAY
45
57
BUZZER
47
DRIVER
13
56
55
54
53
19
M
SW
51
52
SW

HEATING APPARATUS HAVING A SENSOR FOR TERMINATING OPERATION

BACKGROUND OF THE INVENTION

In a heating apparatus, particularly a microwave oven, it is desired to automatically terminate cooking operation when foodstuff has been appropriately cooked. It has been proposed to provide a humidity/gas sensor in the path of air exhausted from the ventilated heating chamber to detect a gaseous substance emitted by foodstuff being cooked as a indication of the condition of the foodstuff. However, difficulty has been encountered to provide an accurate indication of the condition of the heated material.

SUMMARY OF THE INVENTION

It is therefore an object of the present invention to provide a heating apparatus having structure for precisely determining the condition of a material being heated.

The present invention is based on the discovery that the velocity of exhausted air adversely affects the detection of emitted gaseous substance.

According to the present invention, the heating apparatus comprises a chamber in which a material to be heated is placed and a heater for heating the material to cause it to emit a substance in a gaseous state. A fan directs air into the chamber and through an exhaust duct to the outside. The duct has a passage of sufficient length between an inlet and an outlet thereof to produce a laminar airflow therein. An opening is formed in an intermediate position along the length of the duct; the opening allows gas to escape from the duct in a direction substantially perpendicular to the direction of the laminar airflow. An enclosure outside of the opening collects gas diffusing from the duct through the opening. A sensor located in the enclosure detects the diffusing substance to de-energize the heater when the sensor develops a voltage indicating a predetermined condition of the heated material.

BRIEF DESCRIPTION OF THE DRAWINGS

The present invention will be described in further detail when reference to the accompanying drawings, in which.

DETAILED DESCRIPTION OF THE DRAWINGS

Figure 1:
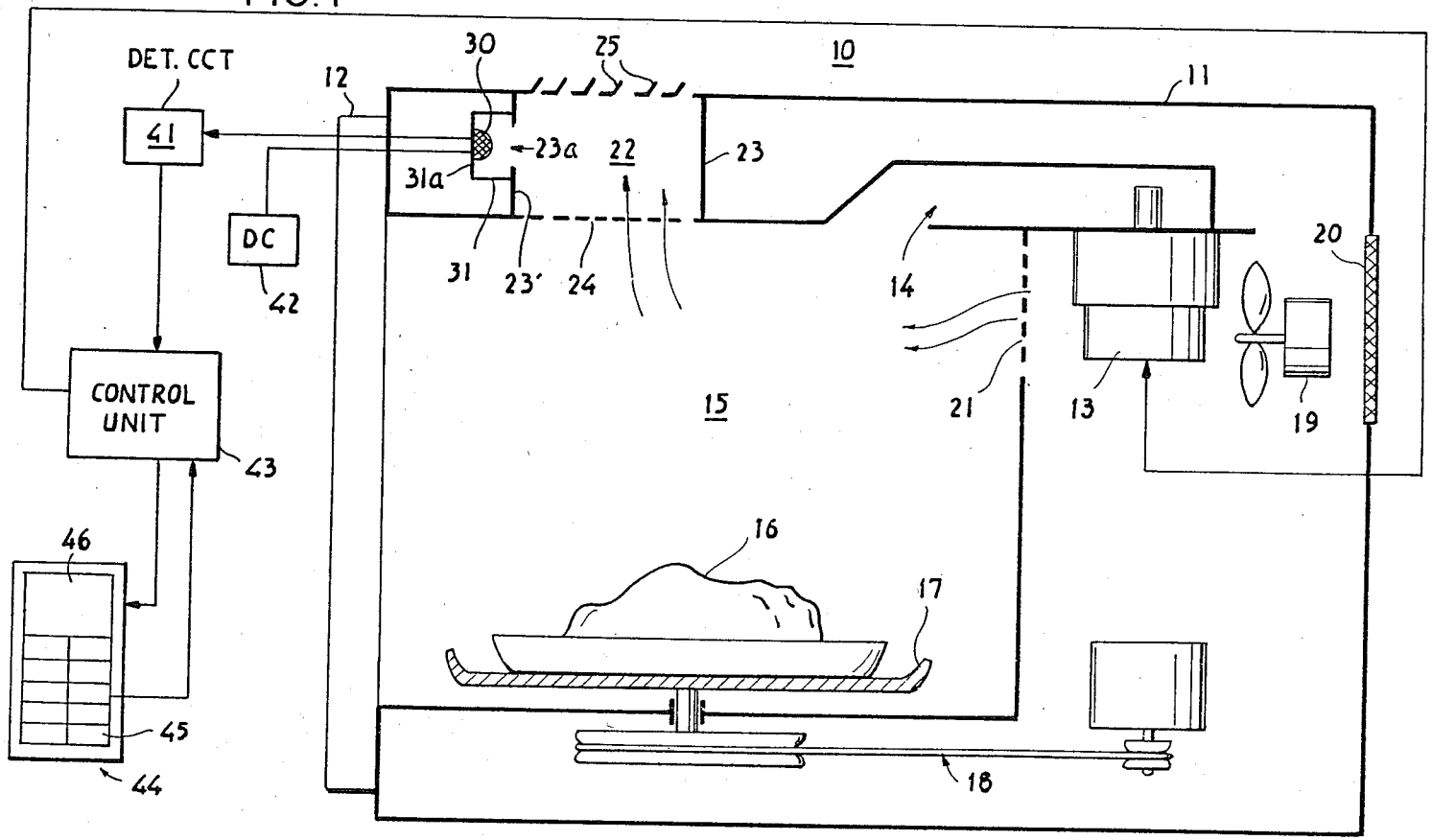
FIG. 1 is an illustration of a microwave oven with a control unit therefor.

Referring now to FIG. 1, there is shown a microwave oven 10 comprising a housing 11 with a hinged door 12. Magnetron 13 is mounted in a position adjacent an energy radiating duct 14 through which microwave energy is radiated into a heating chamber 15 in which foodstuff 16 is placed on a rotating disc 17 driven by a belt-drive system 18. Outside air is drawn by a fan 19 through a filter 20 into the housing 10 to cool the magnetron 13, thence into the cooking chamber 15 through inlet openings 21 provided on a side wall of the chamber. The air inside the chamber 15 is exhausted through a duct 22 defined by side walls 23, a bottom wall having perforations 24 and a top wall having slits with a series of overlapping slats 25. The size of perforations 24 and the slits is such that microwave energy does not leak out of duct 22 while permitting a sufficient amount of smoke to escape through them. The side walls 23 have a sufficient vertical length to produce an upward draft of laminar airflow. The heated foodstuff produces water vapor and gas, which are exhausted through duct 22.

A side wall 23' of the duct 22 is formed with an opening **23*a* which is closed by an enclosure 31 on the outside duct 22. A humidity/gas sensor 30 is mounted on a vertical wall 31*a* of enclosure 31 opposite from opening 23*a*. Because humidity/gas sensor 30 is located away from the path of the bulk of exhausted moisture-laden laminar airflow, the sensor responds only to the diffusing water vapor or gas; the vapor or gas diffuses at a speed proportional to the gradient of vapor/gas concentration between duct 22 and enclosure 31**.

Figure 2:
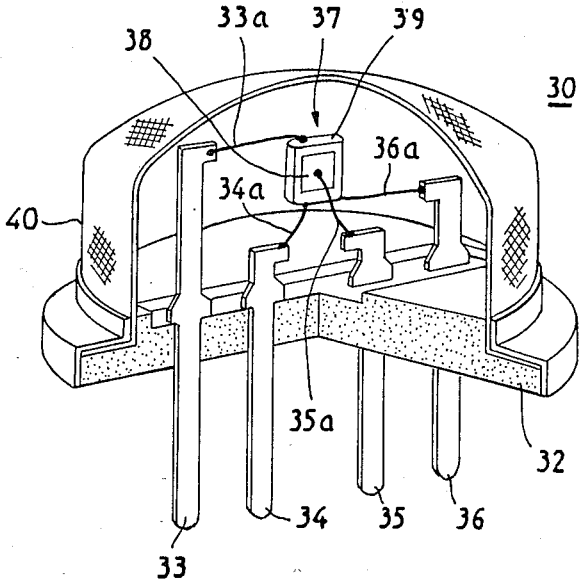
FIG. 2 is a perspective view of a humidity sensor employed in the present invention.

In one embodiment, sensor 30 is of a type which allows detection of absolute humidity. FIG. 2 is an illustration of a typical example of such humidity sensors. The sensor comprises a ceramic base 32, pins 33–36 mounted on base 32, and a sensor chip 37 supported by lead wires **33*a*–36*a*. Chip 37 comprises an inner humidity sensing part 38 which is connected by leads 35*a*, 36*a* and pins 35, 36 to a detector circuit 41 and an outer heating part 39 which is connected by leads 33*a*, 34*a* and pins 33, 34 to a DC voltage source 42. The sensing part of chip 37 is a mixture of MgO and $ZrO_2$ and is heated by the outer heating part 39 so that the sensor part resistance varies in response to the absolute humidity of its environment. A metal net cover 40 is provided over the base 32 to protect the sensor chip 37. This cover 40 has an advantageous effect of keeping the sensing part warm by containing heated air inside the net. The humidity sensor shown in FIG. 2** is available under the tradename "Neohumiceram" from Matsushita Electric Industrial Company. A further suitable sensor is of a gas sensor composed of $SnO_2$ which is available from Figaro Engineering Inc. (Japan).

Figure 3:
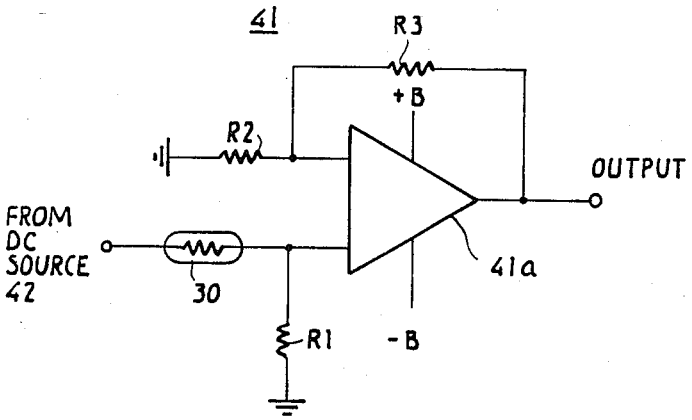
FIG. 3 is a circuit diagram of a detector for amplifying the output of the humidity sensor.

FIG. 3 is circuit diagram of a preferred form of the detector circuit 41 comprising an operational amplifier **41*a*. The humidity sensor 38 is connected to ground by shunt resistor $R_1$, having a resistance less than 1/10 of the nominal resistance value of the humidity sensor 38. The junction between sensor 38 and resistor $R_1$ is connected to a first input of operational amplifier 41*a*. The amplification gain of operational amplifier 41*a* is determined by the ratio $R_3/R_2$ of resistors $R_3$ and $R_2$ which are connected in series from the output of amplifier 41*a* to ground with a junction therebetween being connected to the second input of the amplifier. In a typical example, the nominal value of sensor 38 is 900 kilohms at 20° C. and an absolute humidity of 60%. Therefore, an appropriate value of resistor $R_1$ is in the range between several kilohms to several tens of kilohms. Due to the 1:10 resistance ratio, the detector circuit 41** provides a voltage output which varies substantially linearly as a function of current flowing through the humidity sensor.

Returning to FIG. 1, the apparatus further includes a control unit 43 and a data-entry/display panel 44 having a plurality of keys 45 and a liquid-crystal display 46. Control unit receives data from the data-entry/display panel 44 to initiate a cooking operation according to the contents of input data by energizing magnetron 13 via a driver 47 and further receives an output signal from detector circuit 41 to terminate the cooking operation.

Figure 4:
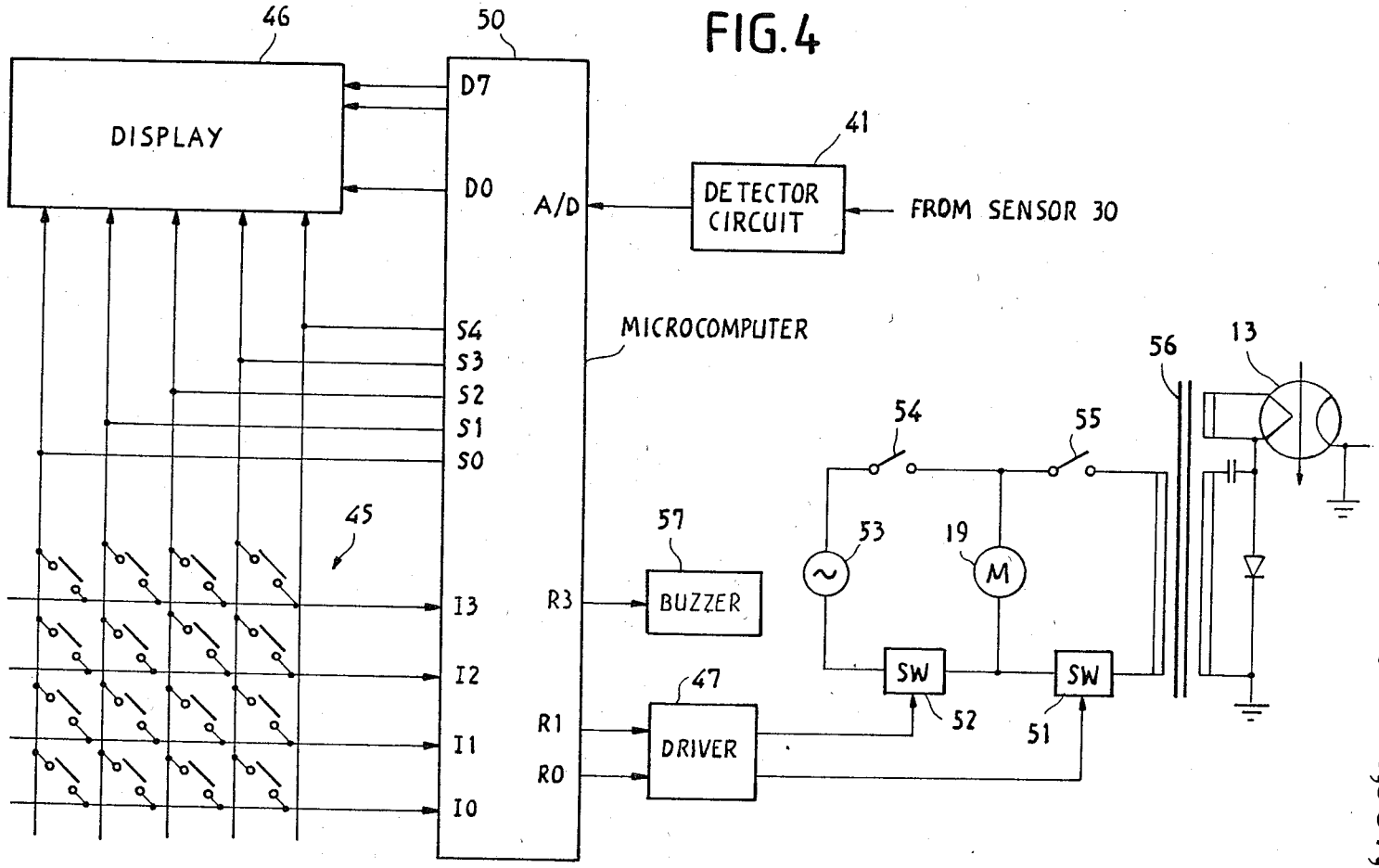
FIG. 4 is a block diagram of the control unit of FIG. 1.

FIG. 4 is a detailed circuit diagram of the structure of the control unit 43. Input data entered by select keys 45 are applied to terminals $I_0$–$I_3$ of a microcomputer 50 which decodes the input data into a series of eight-segment codes which are applied through terminals D0–D7 to display 46 and a series of digit codes applied thereto through terminals S0–S4. The eight-segment digits of the display 46 are dynamically driven on a time-shared basis in order to reduce the number of connecting leads. The output of detector circuit 41 is applied to an analog-to-digital conversion terminal A/D of the microcomputer where the analog value of resistance variation that occurs in the humidity sensor is converted to a corresponding digital code. Driver 47 is connected to output terminals $R_0$, $R_1$ to amplify power turn-on control pulse from terminal $R_1$ and power-level control pulses from terminal R0 and respectively, applies them to series connected switching elements 51 and 52, responsive to AC power source 53; switches 51 and 52 are also in series with door switches 54, 55 and a primary winding of a transformer 56. Switching element 31 completes a circuit for the fan motor 19 and a circuit for the primary winding of the transformer 56, having a secondary winding connected to the cathode of magnetron 13. By varying the duty cycle or frequency of the pulses applied to switching element 31, the power level of the magnetron is controlled. A buzzer 57 is also provided to sound an alarm when cooking operation is terminated in an automatic mode.

Figure 5:
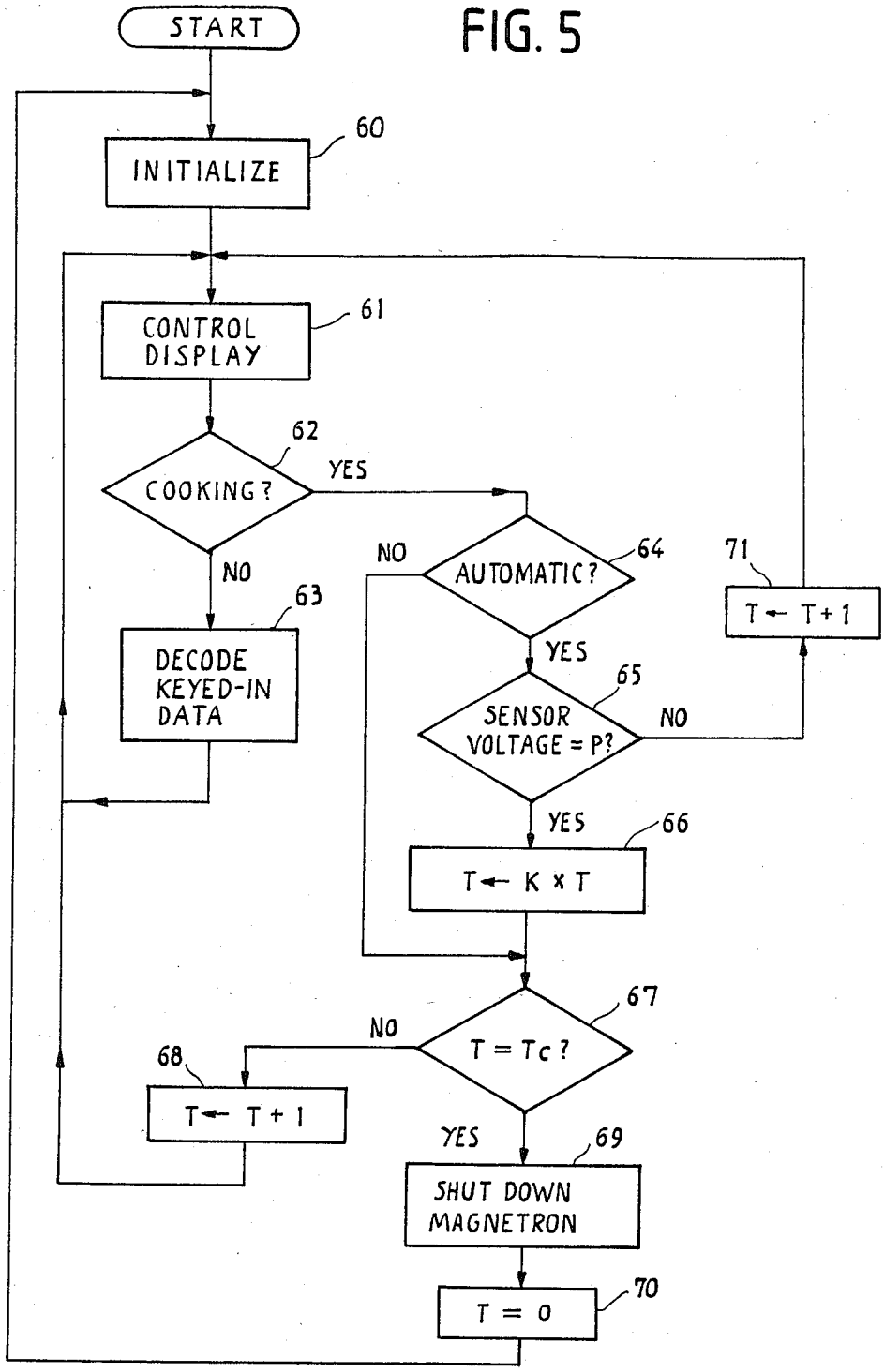
FIG. 5 is a flow diagram of programmed functions performed by the microcomputer of FIG. 4.

FIG. 5 is a flow diagram for the operation of the microcomputer. Computer operation beings initialization step 60 which calls block 61 during which the microcomputer drives the display 46 on a time-shared basis. Decision block 62 follows to check to see if a cooking operation is in progress, and if not, control advances to block 63 to scan the input terminals I0 and I3 to read and decode the input data as described above to put them on display and control returns to block 61. If a cooking operation is in progress, control exits to decision block 64 to check to see if the input data indicate that the operation is in automatic mode and if not, control exits to block 67 to compare a time count value T with a time period Tc which has been entered manually through the data-entry panel 45. Block 68 follows if the set time Tc has not lapsed to increment timer count T by one. Control then returns to block 61 to successively increment the count T until it reaches Tc in block 67, whereupon block 69 follows to shut down magnetron 13 and alert the user by operating buzzer 57. Timer count T is reset to zero in block 70 and control returns to initialization block 60.

If the operation is in automatic mode, block 65 is executed by comparing the digitized value of absolute humidity with a predetermined value P. If the latter has not been reached, block 71 is repeatedly executed by incrementing the timer count T by one until the humidity value P is reached in block 65, whereupon control advances to block 66 to multiply the timer count value T by a constant K (which ranges from zero to 3 depending on the material of the foodstuff being cooked). Timer count value T which is obtained by block 71 is compared with a set value Tc which, in the automatic mode, is determined by the material of the foodstuff dictated by the input data. Blocks 67 and 68 are executed repeatedly until $K \times T$ becomes equal to Tc. Blocks 69 and 70 follow to shut down magnetron 13, operate buzzer 57 and reset timer count T to zero and allow control to return to block 60.

Figure 6:
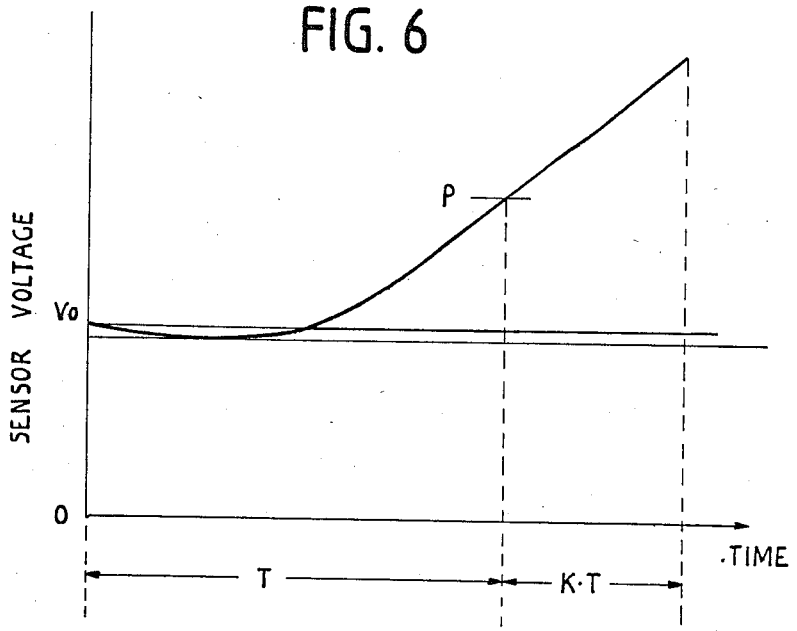
FIG. 6 is a plot of sensor output voltage as a function of time.
Figure 7:
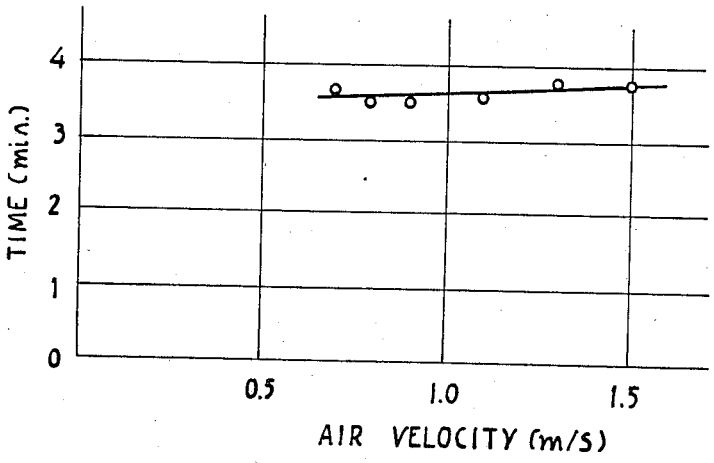
FIG. 7 is a graphic illustration of the result of an experiment showing a plot of time taken to reach a predetermined voltage level as a function of varying exhaust air velocity.

FIG. 6 is a plot of the output of sensor 30 as a function of time. The output voltage Vo initially remains substantially constant, then rises sharply passing the predetermined humidity value P whereupon the microcomputer determines the time T taken to reach that point and further determines the time $K \times T$ to continue the cooking operation. If the humidity sensor 30 were affected by the exhausted airflow, the voltage curve would drop significantly and take longer to reach the threshold P, which results in a foodstuff being overheated. FIG. 7 is a plot of time periods taken to reach the threshold P for a given foodstuff as a function of the velocity of air exhausted through duct 22 which is varied experimentally by controlling the fan 19. As is evident, the time taken to reach that threshold remains substantially constant despite the varying flowrate. The present invention thus provides a cooking apparatus which terminates cooking operation at correct timing.

Figure 8:
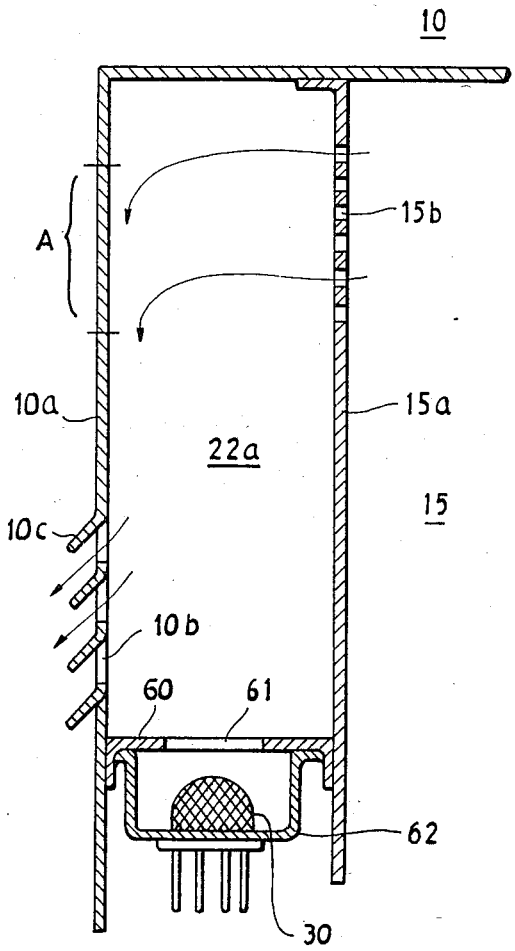
FIG. 8 is a cross-sectional view of a second embodiment of the invention.

FIG. 8 is an illustration of a second embodiment of the present invention. In this embodiment, exhaust duct **22*a* is provided on a side wall 15*a* of cooking chamber 15 and defined between it and a side wall 10*a* of housing 10. Perforations 15*b* are provided on side wall 15*a* adjacent the upper end of duct 22*a* to admit air from chamber 15 and slits 10*b*. A series of louver boards 10*c* are formed on side wall 10*a* adjacent the lower end of duct 22*a* to exhaust the air to the outside. The lower end of duct 22*a* terminates with a wall member 60 having an opening 61. An enclosure 62 is secured to wall member 60 to accommodate the sensor 30 therein. Duct 22*a* has a longer vertical dimension than its horizontal dimension so that the air admitted through perforations 15*b* strikes an upper portion A of side wall 10*a*, is deflected downwardly, and cooks as it descends. The admitted air turns gradually as it passes through slits 10*b* and is guided by downwardly extending louver boards 10*c*. As the air hits the wall portion A, grease or oily components carried by the exhaust air sticks to that wall portion and the grease-free air moves past the sensor 30. The surface of sensor 30 is thus kept free from the greasy material and remains responsive at a constant sensitivity to water vapor or gas. Due to the cooling effect of the vertically extended duct 22*a* the sensor 30** is protected from the otherwise high temperatur water vapor or gas. For this reason, this embodiment is particularly advantageous for a microwave oven of the type having a resistance heater mounted on the top wall of the cooking chamber to produce a browning effect on the surface of foodstuff.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A heating apparatus comprising:
a chamber in which a material to be heated is placed;
means for heating said material to cause it to emit a gaseous substance;
fan means for directing air into said chamber;
duct means connected to said chamber for exhausting the air directed into the chamber to outside of the chamber, the duct means having a sufficiently long airflow passage between an inlet and an outlet thereof so the air exhausted through it has substantially laminar flow therein, the duct means having an opening on a side wall positioned to be responsive to a diffusing portion of the laminar flow;
enclosure means, the opening being closed by said enclosure means, the opening and enclosure means being arranged so said substance diffuses from said duct means through said opening into the enclosure means,
sensor means in said enclosure means for detecting said diffusing substance; and
means responsive to said sensor means for de-energizing said heating means.

2. A heating apparatus as claimed in claim 1, wherein the inlet of said duct means is located on one side wall of, and at one end of, said duct means to cause the exhausted air to strike a portion of an other side wall of said duct means, said another side wall being opposite to said inlet.

3. A heating apparatus as claimed in claim 2, wherein said duct means extends vertically, the inlet of said duct means being located at a higher position than the outlet of said duct means and said sensor means being located at a lowermost position of said duct means.

4. A heating apparatus as claimed in claim 1, wherein said sensor means comprises an absolute humidity sensor.

5. A heating apparatus as claimed in claim 4, wherein said sensor means comprises a sensing part and a heating part for heating the sensing part into an active state.

6. A heating apparatus as claimed in claim 5, wherein said sensing part has a predetermined resistance value, further comprising a detector circuit which comprises:
a resistor having a resistance value smaller than said predetermined resistance value and connected with said sensing part in a series circuit from a voltage source to a reference potential; and
amplifier means for amplifying a voltage developed at a junction between said resistor and said sensing part.

7. The heating apparatus of claim 1 wherein the duct has a vertically extending longitudinal axis along which the laminar flow between the inlet and outlet is induced, the inlet and outlet being horizontally disposed, the opening being in line with the longitudinal axis and downstream of the outlet so the diffuse flow through the opening is generally in the vertical direction.

8. The heating apparatus of claim 1 wherein the inlet and outlet are generally aligned and horizontally disposed so the laminar flow is induced in a vertical direction between them, the opening being vertically disposed so the diffuse flow through it is generally in the horizontal direction.

9. A cooking apparatus comprising:
a chamber in which a foodstuff is placed;
a microwave energy generating means for heating said foodstuff to cause it to emit a gaseous substance;
fan means for directing air into said chamber;
duct means connected to said chamber for exhausting the air directed into the chamber to outside of the chamber, the duct means having a sufficiently long airflow passage between an inlet and an outlet thereof so the air exhausted through it has substantially laminar flow therein, the duct means having an opening on a side wall positioned to be responsive to a diffusing portion of the laminar flow;
enclosure means, the opening being closed by said enclosure means, the opening and enclosure means being arranged so said substance diffuses from said duct means through said opening into the enclosure means;
sensor means in said enclosure means for detecting said diffusing substance; and
control means responsive to said sensor means for de-energizing said heating means.

10. A heating apparatus as claimed in claim 9, wherein the inlet of said duct means is located on one side wall of, and at one end of, said duct means to cause the exhausted air to strike a portion of an other side wall of said duct means, said another side wall being opposite to said inlet.

11. A cooking apparatus as claimed in claim 10, wherein said duct means vertically extends, the inlet of said duct means being located at a higher position than the outlet of said duct means and said sensor means being located at a lowermost position of said duct means.

12. A cooking apparatus as claimed in claim 9, wherein said sensor means comprises an absolute humidity sensor.

13. A cooking apparatus as claimed in claim 12, wherein said sensor means comprises a sensing part and a heating part for heating the sensing part into an active state.

14. A cooking apparatus as claimed in claim 13, wherein said sensing part has a predetermined resistance value, further comprising a detector circuit which comprises:
a resistor having a resistance value smaller than said predetermined resistance value and connected with said sensing part in a series circuit from a voltage source to a reference potential; and
amplifier means for amplifying a voltage developed at a junction between said resistor and said sensing part.

15. A cooking apparatus as claimed in claim 14, wherein said control means comprises means for comparing the output of said amplifying means with a predetermined value, detecting the time taken to reach said predetermined value, multiplying the detected time by a factor which is variable depending on the material of said foodstuff, and de-energizing said microwave energy generating means at the end of said multiplied time.

16. A cooking apparatus as claimed in claim 9, wherein the inlet of said duct means has a plurality of perforations each being dimensioned to prevent said microwave energy from leaking to the outside of said duct means.

17. In a method of determining the extent to which foodstuff being heated by microwave energy in a microwave oven has been cooked, the foodstuff as it is being cooked by the microwave energy emitting vapor that mixes with air in the oven to form a vapor-air mixture, comprising the steps of:

inducing a laminar flow of the mixture in a duct, inducing a diffuse flow of a portion of the mixture having laminar flow in the duct, and detecting the absolute humidity of the portion of the mixture having the diffuse flow.

18. The method of claim 17 wherein the diffuse flow is induced from the mixture having laminar flow through an opening in the duct between an inlet and outlet of the duct.

19. The method of claim 17 wherein the diffuse flow is induced from the mixture having laminar flow through an opening in the duct downstream of an outlet of the duct.

* * * * *